US006955033B2

(12) United States Patent
Lortz

(10) Patent No.: US 6,955,033 B2
(45) Date of Patent: Oct. 18, 2005

(54) METHOD OF PUSHING TUBULAR FILMS ONTO ELONGATE OBJECTS AND PROCESSING APPARATUS FOR IMPLEMENTING THE METHOD

(76) Inventor: Hans-Joachim Lortz, Römerhofstrasse 9, Gross Umstadt (DE), 64823

( * ) Notice: Subject to any disclaimer, the term of this patent is extended or adjusted under 35 U.S.C. 154(b) by 96 days.

(21) Appl. No.: 10/205,217

(22) Filed: Jul. 24, 2002

(65) Prior Publication Data

US 2004/0016207 A1 Jan. 29, 2004

(51) Int. Cl.[7] ..... B65B 11/00
(52) U.S. Cl. ..... 53/585; 53/557
(58) Field of Search ..... 53/582, 585, 580, 53/137.2, 557, 252, 258, 259, 260, 290, 291, 298

(56) References Cited

U.S. PATENT DOCUMENTS

| | | | | | |
|---|---|---|---|---|---|
| 1,206,901 | A | * | 12/1916 | Paridon | 53/141 |
| 2,033,238 | A | * | 3/1936 | Geyer et al. | 426/104 |
| 2,180,349 | A | * | 11/1939 | De Back | 53/515 |
| 3,284,981 | A | * | 11/1966 | Broersma | 53/529 |
| 3,557,526 | A | | 1/1971 | Hartmann | |
| 3,608,270 | A | * | 9/1971 | Rudszinat et al. | 53/530 |
| 3,667,188 | A | * | 6/1972 | Benner et al. | 53/443 |
| 4,144,631 | A | * | 3/1979 | Fujio | 29/446 |
| 4,177,546 | A | * | 12/1979 | Geisinger | 29/235 |
| 4,519,186 | A | * | 5/1985 | Winter et al. | 53/565 |
| 4,590,748 | A | * | 5/1986 | Harrison et al. | 53/576 |
| 4,660,357 | A | * | 4/1987 | Fresnel | 53/585 |
| 4,765,121 | A | * | 8/1988 | Konstantin et al. | 53/442 |
| 5,129,209 | A | * | 7/1992 | Focke | 53/136.1 |
| 5,566,527 | A | * | 10/1996 | Drewitz | 53/295 |

FOREIGN PATENT DOCUMENTS

| | | | | |
|---|---|---|---|---|
| DE | 2 321 457 | | 1/1974 | |
| DE | 3424081 | A1 | 2/1985 | |
| DE | 197 37 689 | A1 | 3/1999 | |
| DE | 199 08 395 | A1 | 9/2000 | |
| DE | 100 38 572 | A1 | 2/2002 | |
| EP | 0 075 933 | A1 | 4/1983 | |
| EP | 0 899 082 | A2 | 3/1999 | |
| EP | 1 033 308 | * | 9/2000 | B65B/53/02 |
| FR | 2 730 210 | A1 | 8/1996 | |
| FR | 2 738 797 | A1 | 3/1997 | |

* cited by examiner

*Primary Examiner*—Rinaldi I. Rada
*Assistant Examiner*—Paul Durand
(74) *Attorney, Agent, or Firm*—Squire, Sanders & Dempsey

(57) ABSTRACT

The invention relates to apparatuses and a method for pushing tubular films over elongate objects, which preferably have varying cross sections, in which one, preferably two, conveyors (5, 6) transport the objects (4) lying freely, by the objects (4) being held, preferably in a clamping manner, at at least one, preferably at both ends, by a holding device (7), in which a pushing means guides a sleeve (27), on which the film tube (9) is arranged, over the object (4) in order to withdraw the sleeve again at a later time, in which a further pushing means (28, 32) holds the film tube in such a way that the film tube is pushed off the sleeve as the sleeve (27) is withdrawn, in order then to extend around the object.

15 Claims, 7 Drawing Sheets

Section A–A Figure 2 a
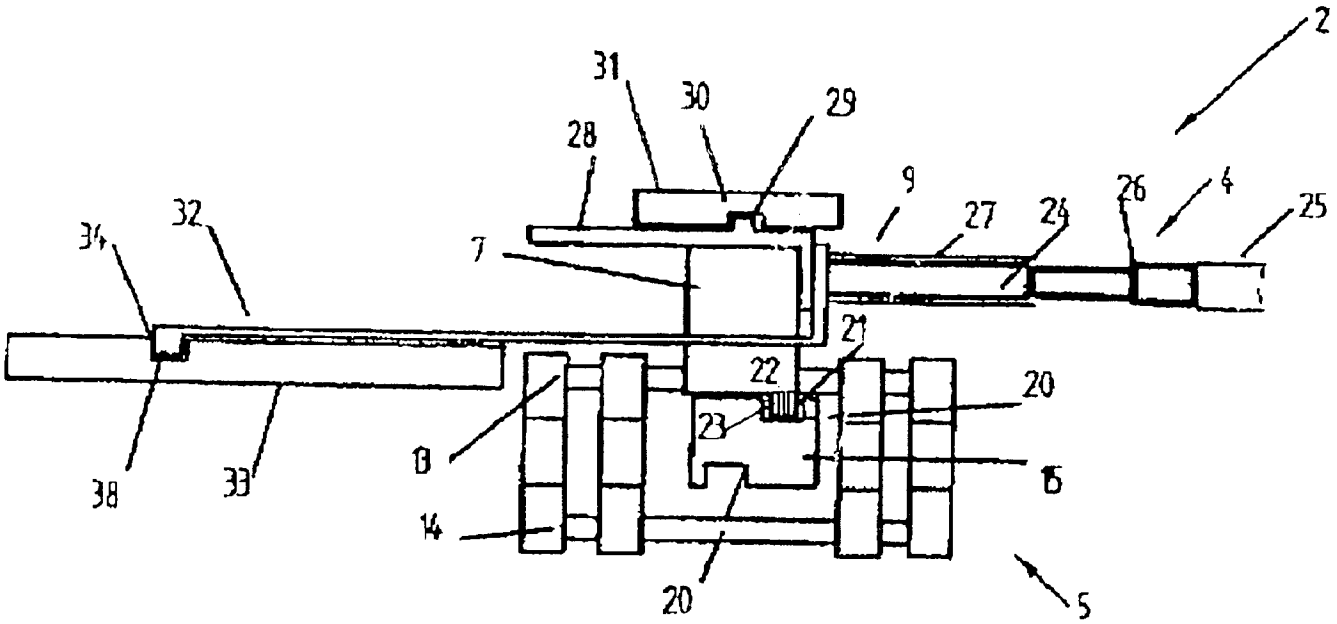

Section A-A

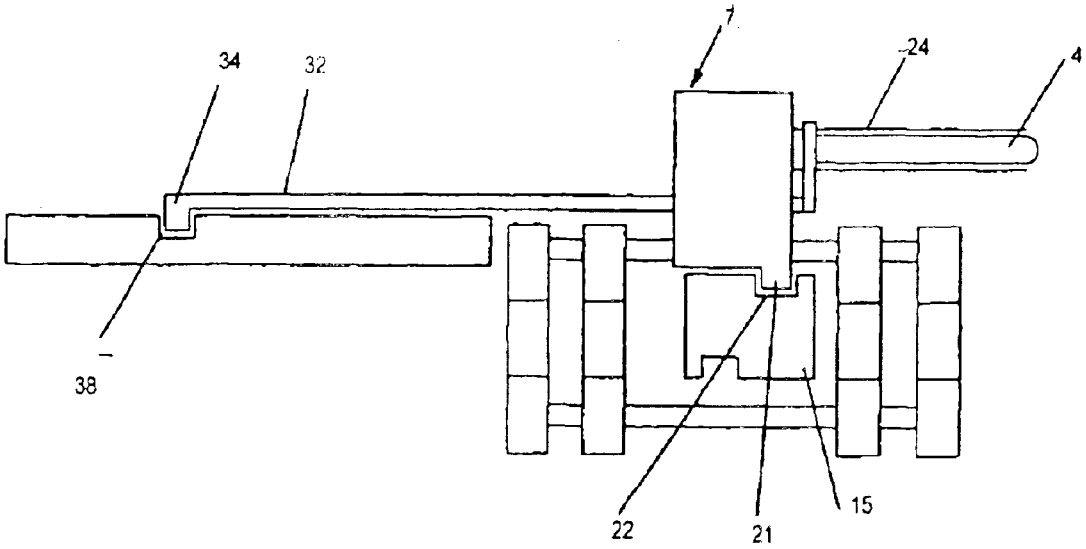
(Prior Art) Fig. 2c

METHOD OF PUSHING TUBULAR FILMS ONTO ELONGATE OBJECTS AND PROCESSING APPARATUS FOR IMPLEMENTING THE METHOD

TECHNICAL FIELD OF THE INVENTION

The invention relates to a method of pushing tubular films over elongate objects which are transported continuously transversely to their longitudinal axis.

In the case of writing materials, such as pens and pencils with covering sleeves, and also in the case of cosmetic packaging, for lipsticks, eyebrow pencils and the like, which are likewise provided with covering sleeves, elongate objects with a cross-sectional course which changes non-uniformly and abruptly over their length are present.

The same applies in practice to all elongate objects which are transported in a case, the case being closed with a sleeve closed on one side. These objects also include elongate musical instruments, for example flutes, in which the mouthpiece has an external diameter greater than that of the flute tube.

All these elongate objects, which can have any desired cross-sectional shape, to be specific for example round in the sleeve closure and can, for example, be formed as a polygon in the shaft, or as flat cases with various rectangular cross sections, it being possible for the narrow sides of the rectangles to be rounded, often come onto the market as mass-produced products.

Irrespective of the quality of the content, it has previously not been possible to provide reliable detection of unauthorized opening of these containers and use of the content before the final use.

In particular in the case of high-value cosmetic packaging, such as bottles with closures of relatively large cross section placed on them, it is frequently only detected after purchase that such an object has already been used before being purchased. Frequently, such elongate objects are decorated with elevations which are arranged on the circumference of the object and extend at right angles to the longitudinal direction and in which, for example, the closure is contained between the upper and lower part.

PRIOR ART

DE 19737689 and 199 08 395 disclose an apparatus which continuously guides tubular films over elongate objects. However, in the case of this apparatus, problems always occur when the film is to be guided over an object with different cross sections, or over an object which is very sensitive and therefore does not tolerate any high frictional forces. This is to be attributed to the fact that the film is pushed directly over the object.

DE 3424081 discloses an apparatus in which first of all a film is welded to form a sleeve, which is then pushed over the object in the manner of a telescope. However, this apparatus does not take into account different cross sections and diameters of objects nor the problems of objects which can be broken and destroyed easily.

BACKGROUND OF THE INVENTION

On this basis, the present invention is based on the object of sheathing an elongate object by means of a film which can be shrunk on, irrespective of the cross-sectional course over its length, without causing any kind of damage on the surface of the object when a film tube is pushed over it, nor any damage to the film tube itself which arises as a result of alignment errors between film tube and elongate object. This object is achieved by the inventive method features of claim 1 in that, for elongate objects with a nonuniform cross-sectional course over their length, continuously first of all a tubular film aligned in relation to the longitudinal axis of the individual elongate object is opened, is guided to an intermediate storage facility in the open state and is brought to a predefined length, in that, after the elongate object has been stopped and aligned in relation to the stored piece of tubular film, the latter is moved on synchronously with the elongate object and with the intermediate store, while maintaining its position in the intermediate store and, until the start of a cross-sectional course of the object which changes abruptly transversely to its longitudinal direction, is pushed onto the elongate object, in that the piece of tubular film is then pushed further on its own over the changed cross section of the elongate body up to a predefined point, while the intermediate storage facility is withdrawn, and in that after the locking has been removed the tubular film is then shrunk onto the elongate object. In a further embodiment, the sleeve is guided completely over the object in order then to push the film tube off. As a result of the alignment according to the invention and the guidance of the tubular film to be pushed on until the abrupt change in the cross section in the circumferential direction of the elongate object to be sealed, contact between film and object will take place for the first time in the area of the abrupt change, so that damage to the object to be sheathed cannot occur in the area of the small cross section or on the film tube. If it is pushed freely onto the elongate object, the film tube strikes the shoulder which is present and is necessarily destroyed, which leads to considerable wastage. According to the invention, the object to be sealed, with its larger cross section, now itself provides clean guidance of the film to be shrunk on until the latter reaches its predefined position.

One refinement of the subject of the invention is seen in the fact that, during the continuous transport of the elongate objects, a piece of tubular film is cut off synchronously with the movement of the individual elongate object and fed to an intermediate storage facility moved synchronously with the elongate object. By means of an inventive refinement of this type, bottlenecks in the continuous sealing of such elongate objects, which have to be transported lying down, are unambiguously avoided. As a result of this procedure, the change to synchronous running during the transition from store to elongate body can also be managed reliably.

In a still further refinement of the inventive method, it is proposed that one end of the section of tubular film be expanded as it is put into the storage facility. This inventive refinement takes account of extreme cross-sectional changes in the course of an elongate object. For example, in the case of a sleeve closure which is designed as a double cone, in the longitudinal direction of the elongate object, this provides for the first time the possibility, by means of appropriate expansion, of overcoming the first conical section without obstructions and, during the subsequent shrinking, of closing the second conical section reliably.

Starting from a processing apparatus for shrinkable film tubes with conveying devices for their opening, cutting off and feeding the opened sections, for covering elongate objects transported continuously in the horizontal direction transversely to the forward direction of the conveyors, this apparatus for implementing the method is distinguished in that at least three conveyors are provided beside one another, circulating at synchronous speed with their leading runs horizontal. In this case, the central conveyor arranged between the two outer conveyors has carrying units for elongate objects with various cross sections which are to be covered and are transported transversely to the forward direction of the conveyors. The two outer conveyors have holding devices extending transversely to their conveying direction. The holding devices are designed at the same time as auxiliary mandrels with sleeves surrounding the latter for the opened sections of the film tubes to be pushed on. After being opened with the aid of the drive rollers, the pieces of film tube to be pushed on are pushed onto the sleeves with a corresponding length, synchronously with the movement of the object to be covered, by an opening mandrel mounted horizontally between drive rollers and are cut off the film tube. The auxiliary mandrel and the sleeve associated with the latter are each connected to a sliding device, separated from each other. The sliding devices are moved forward and back transversely to the forward direction of the conveyors and independently of each other as a function of further guides which extend along the conveying direction and are arranged separately from each other. The elongate object of variable cross section is carried only by the holding devices, free of the central conveyor, as the piece of film tube is pushed on. The elongate object, including the shrinkable piece of tube pushed on, is then fed to a shrink channel. As a result of the interaction according to the invention of an opening mandrel mounted horizontally between drive rollers in conjunction with a sleeve that can be pushed onto an auxiliary mandrel, and the reliable guidance during the pushing-on operation following orientation of the elongate object in relation to the auxiliary mandrel as far as the cross-sectional change or over the latter onto the elongate object, in conjunction with reverse control of the sleeve according to the invention during the action of pushing the piece of film tube further onto the sleeve as far as the predefined position on the elongate object, reliable shrinkage, above all not damaging the object, becomes possible. An object sealed in this way provides the guarantee that elongate objects damaged before purchase can be detected reliably.

In a refinement of the processing apparatus according to the invention, protection is claimed for the fact that the wall thickness of the sleeve corresponds to the cross-sectional change which occurs in the elongate object transported lying down.

In a still further refinement of the subject of the invention, it is proposed that each holding device that extends transversely carry a guide extension, and that the guide extension extend in a guide track arranged between the forward and reverse run of the at least one outer endlessly circulating conveyor. This ensures that the elongate object to be covered, which is continuously transported lying down, is guided reliably by the driven holding devices, without additional conveyors, even during the pushing-on operation.

In a still further refinement of the subject of the invention, it is disclosed that each holding device that extends transversely has an auxiliary mandrel pushing guide with a guide pin and a sleeve pushing guide with a further guide pin. By means of the separate pushing guides, the processing apparatus according to the invention can be operated both synchronously, which is of considerable advantage for the travel as far as the cross-sectional change, and, according to the invention, it is also possible for any desired mutually different speeds of the interacting components to be reached.

In a still further refinement of the processing apparatus according to the invention a description is given of the fact that the opening mandrel that extends horizontally is supported horizontally on a generating line on a pair of drive rollers, that a further pair of drive rollers guides the opening mandrel on a further, opposite generating line, offset by 180° in relation to the first drive rollers, that the two pairs are aligned parallel with each other, that the distance between the drive rollers forming a pair is different in each pair, that each drive roller is assigned a pair of opposing rollers in the opening mandrel and is operatively connected to the latter, and that the axes of the opposing rollers extend transversely to the longitudinal axis of the opening mandrel. As a result of the arrangement according to the invention of two opposite pairs of drive rollers each having a different mutual roller spacing, firstly the opening of the tube over the opening mandrel is assisted considerably while, at the same time, the opening mandrel is guided unambiguously in the direction of the opposite arrangement comprising auxiliary mandrel with sleeve, and there is virtually no restriction of the diameter of the opening mandrel down to the smallest opening mandrel diameters. Furthermore, as a result the auxiliary mandrel can be designed with any desired cross sections with reliable horizontal guidance, without additional auxiliary devices being needed. This has not been possible hitherto, especially in the case of elongate objects which point in the direction of a rectangular cross section.

In a still further refinement of the subject of the invention, it is disclosed that the drive rollers are V-shaped, and that the base of the V shape is matched to the surfaces of the associated opposing rollers. Interaction of this type according to the invention between drive roller and respective pair of opposing rollers expands the area of application of the opening mandrel according to the invention, in particular with regard to cross sections which differ from the circular shape and, nevertheless, carry sleeve closures, as is common in cases.

In a still further refinement of the subject of the invention, it is described below that the axes of the opposing rollers extend transversely to and through the central axis of the opening mandrel, and that, in the area of the opposing rollers, the opening mandrel has milled-in sections for the surface of the V-shaped drive rollers. As a result of this refinement according to the invention, it is only the cross section of the opening mandrel which is the measure of elongate objects to be provided with shrink film.

DETAILED DESCRIPTION

In the following description, the invention will be explained in more detail using exemplary embodiments. In the figures:

FIG. 1 shows a plan view of a processing apparatus according to the invention.

FIG. 2*a* shows a section AA through FIG. 1 in the area of the opening mandrel FIG. 2*b* shows a section AA through FIG. 1 in the area of cutting device FIG. 2*c* shows a section AA through a s prior art system in the area of the opening mandrel.

In the following description, identical components are designated by the same reference numbers.

Figure 1:
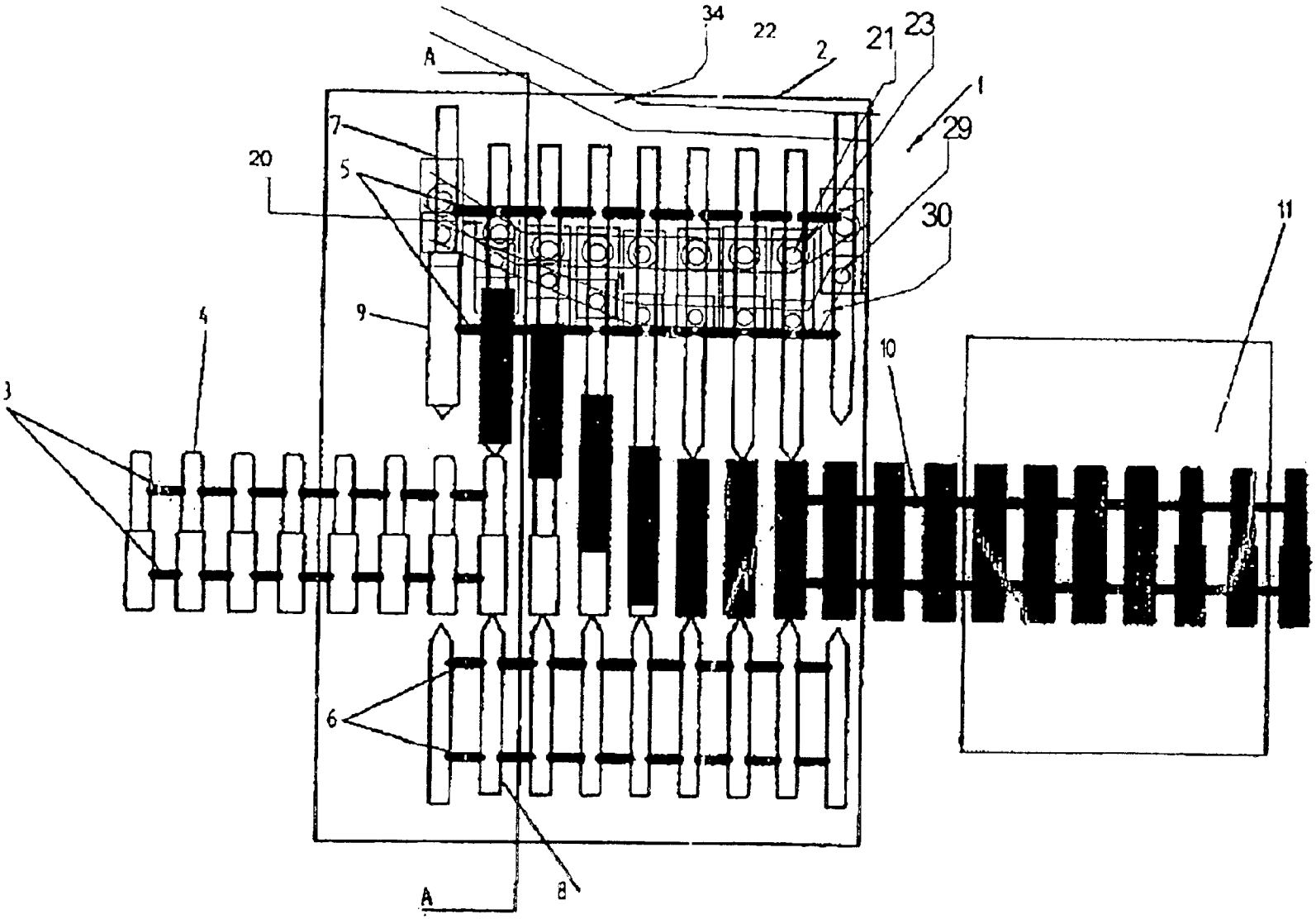

A processing apparatus 1 illustrated in plan view in FIG. 1 comprises, in the processing area 2, three horizontal conveyors which are arranged beside one another, a feed conveyor 3 extending with its forward run from left to right according to FIG. 1.

Upstream of the processing area 2, elongate objects 4 are transported continuously on the feed conveyor 3 in holders, not illustrated, aligned parallel with one another and at the same height above the feed conveyor 3. According to the exemplary embodiment of FIG. 1, the feed conveyor 3 is designed as a double chain conveyor in order that the elongate objects 4 can be transported safely.

In the processing area 2, holding conveyors 5 and 6, which are likewise designed as double chain conveyors, are provided on the left and right of the feed conveyor 3. According to the exemplary embodiment of FIG. 1, only the holding conveyor 5 carries movable holding devices 7, while the holding conveyor 6 carries only stationary holding devices 8, on which the elongate objects, which are transported continuously at fixed intervals transversely to the conveying direction of the feed conveyor 3, are supported when the movable holding devices 7 accept the other end of the elongate object 4.

In the processing area 2, the holding conveyors 5 and 6 run in parallel and at the same height as the feed conveyor 3 at synchronous speed, so that safe transport of the elongate objects 4 is ensured, even when the feed conveyor 3, as an endlessly circulating chain conveyor, is transferred downward in the processing area, by a deflection roller, not illustrated, into its return run, so that the elongate objects 4 which are to be covered with sections 9 of tubular film are firmly held only by the holding devices 7 and 8 acting on their end faces.

After the elongate objects 4 have been provided with sections 9 of tubular film in the processing area 2, said objects are transferred continuously to the forward run of a further horizontal conveyor 10. This further horizontal conveyor 10 is also aligned with the other horizontal conveyors, so that horizontal transport of the elongate objects 4 lying down and with sections 9 of tubular film is carried out without interruption. The elongate objects 4 are fed transversely to the conveying direction of the horizontal conveyor 10 to a shrink tunnel 11 and there are permanently combined with the sections 9 of tubular film enclosing them.

Instead of the processing apparatus 1 illustrated schematically in FIG. 1, the scope of the invention can also cover a processing apparatus in which, according to the invention, the holding conveyor 6 also has movable holding devices 7 which are equipped in the same way as the holding devices according to the invention, as will be explained in more detail in FIG. 2.

A processing apparatus of this type is suitable in particular for elongate objects like pens or pencils, it being possible for these to be all types of pens or pencils, their width being less than the cross section of the elongate holder. In this case, the screwdriver blade and the spatula blade, for example, are accommodated by the movable holding devices and then, as explained in more detail in relation to FIGS. 2 and 4, each covered with a piece of tubular film on each side as far as the area of the elongate holder in order in this way to achieve reliable sealing.

If the elongate holder has a weakening in its cross section or two shoulders in the area of its longitudinal center, then according to the invention, in spite of the use of two sections of film tube, which are pushed onto the elongate holder from left and right, it is ensured that, after the films have been shrunk on, it is not possible to pull them off outward without destroying the films.

The section AA through the processing area 2 illustrated in FIG. 2 shows, in "a", the process of pushing a shrinkable tubular film over and onto an elongate object 4 held firmly between a movable holding device 7 and a stationary holding device 8, and "b" shows the opening of a tubular film 16 by means of an opening mandrel 17, a first pair of drive rollers 118, 119 which mounts said opening mandrel 17, and a second pair of drive rollers 120, 121. It also shows the transfer of the tubular film 16 to the movable holding device 7 and cutting up the tubular film 16 into sections 9 of tubular film by means of a rotating knife 21. The tubular film is arranged on a roller 35.

According to FIG. 2*a*, a slotted guide 15 is permanently arranged between a forward run 13 and a reverse run 14 of the holding conveyor 5, a groove 20 running along on the surface of the stationary slotted guide as a guide track. The movable holding device 7 has a pin 21 which, in the exemplary embodiment, is designed as a ball bearing 23 that can rotate about an axis 22, the movable holding device 7 being moved forward and backward corresponding to the conveying movement of the holding conveyor 5. The holding conveyor 5 is a double chain conveyor, which can be constructed as a roller or link chain conveyor. The movable holding device 7 carries an auxiliary mandrel 24 which, as a result of the pin 21 being guided in the groove 20, comes into an operative connection with an end face of the elongate object 4 as the holding conveyor 5 moves forward. A further auxiliary mandrel 25, which is arranged on the stationary holding arrangement 8 not illustrated in 2*a* and likewise circulates synchronously with the holding conveyor 5 in a rectilinear guide groove as a result of the forward movement of the holding conveyor 6, not illustrated, likewise comes into an operative connection with the other end of the elongate object 4. This ensures that, after the feed conveyor 3 has returned, the elongate object 4 can be held securely at its opposite end faces and can be provided with a section of tubular film in the processing area 2.

In the exemplary embodiment, a cylindrical body with a circumferential shoulder 26 was illustrated as the elongate object 4. However, as already established at the beginning, any elongate bodily shape with cross-sectional changes is to be covered in the same way with sections 9 of tubular film. The subject of the invention also unambiguously includes the case where, instead of the stationary holding device 8 not illustrated in FIG. 2*a*, the movable holding device 7 illustrated in FIG. 2*a* is likewise inserted into the holding conveyor 6. This then produces a processing area 2 in which elongate objects with a plurality of cross-sectional changes can be provided over their length with tubular films that can be pushed on in accordance with the invention.

After the elongate object 4 has been fixed between the auxiliary mandrels 24, 25, the sleeve 27 surrounding the auxiliary mandrel 24, including the section 9 of tubular film which has been pushed onto the surface of the auxiliary mandrel (in this regard, see also FIG. 3), can be pushed forward as far as the shoulder 26 of the elongate object 4 with the aid of a first pushing device 28, which can be formed with a guide pin 29 which is equivalent to the pin 21, by means of a further guide groove 30 in an additional slotted guide 31. The further guide groove 30 in the additional stationary slotted guide 31 is matched to the configuration of the elongate object 4, so that the sleeve 27 adjoins the shoulder 26 without any interspace, so that, with the aid of the further pushing device 32, which is guided in a still further groove 34 in another slotted guide, the section 9 of tubular film is now pushed on without any transition as far as a predefined point of the thicker part of the elongate object 4, in particular as far as the end of the latter or projecting beyond the latter, if the end faces are to be sealed.

While the section 9 of tubular film is being pushed onto the thicker part, the pushing device 28 is withdrawn as far as the end of the auxiliary pin on the movable holding device 7 by the further guide groove 30. After the section 9 of tubular film to be pushed on has reached its position, the further pushing device 32 is also withdrawn to its zero position. The elongate object 4 prepared in this way and transported horizontally is then passed on to the horizontal conveyor 10, which likewise has carrying devices, and is fed to a shrink tunnel 11.

Figure 2B:
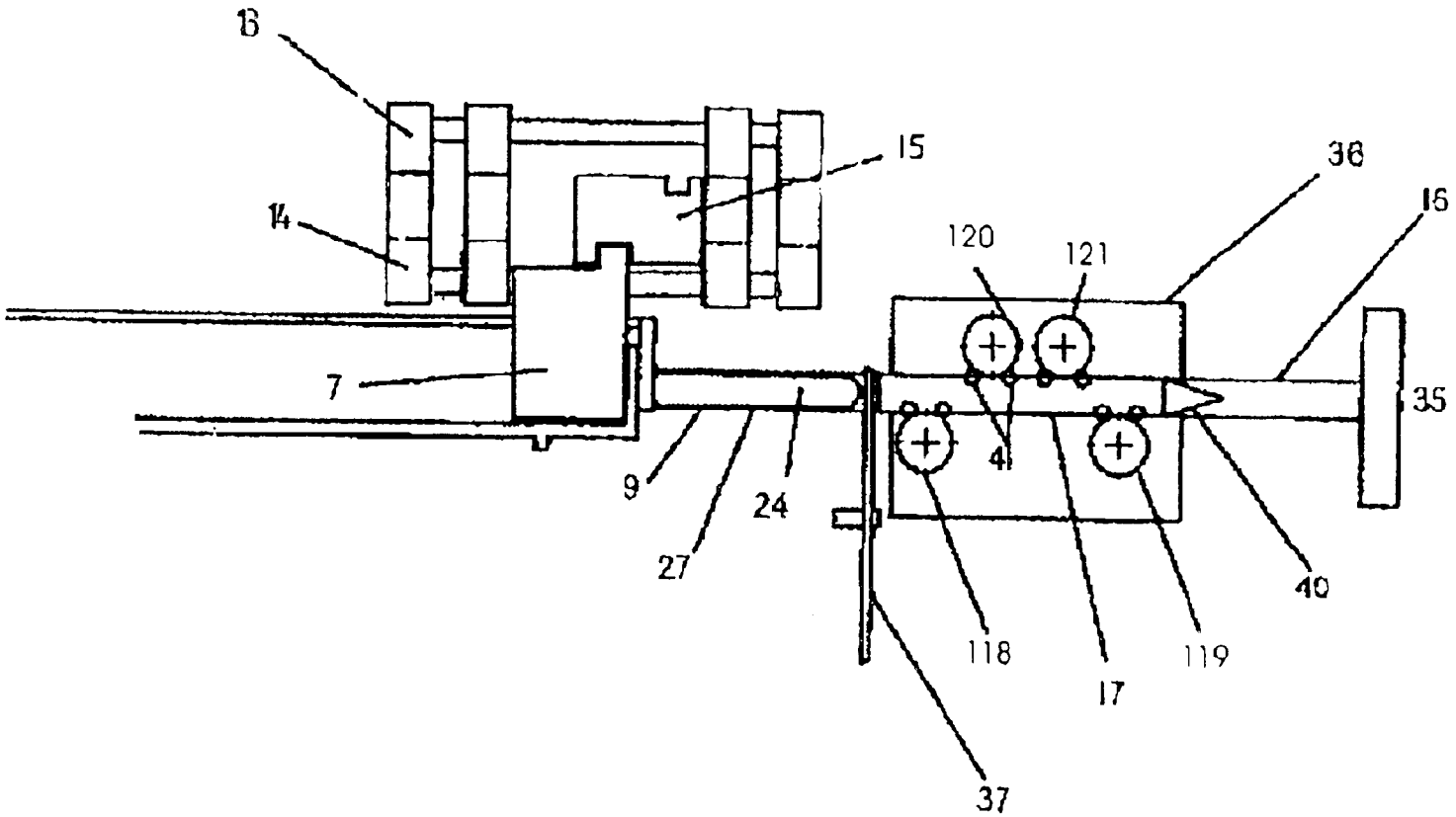

According to FIG. 2*b*, the movable holding device 7 is in the zero position in the area of the reverse run of the holding conveyor 5 and is guided around there synchronously and continuously with the aid of the holding conveyor 5 without any longitudinal movements transversely to the conveying direction. Likewise, the pushing devices 28 and the further pushing device 32 are in the zero position, so that the auxiliary mandrel 24 with the sleeve 27 surrounding the latter is ready to accept a section 9 of tubular film. For this purpose, a tubular film 16 lying flat is fed from a supply, not illustrated, over a deflection roller to an opening mandrel 17. The horizontally extending opening mandrel 17 is mounted in a first pair of drive rollers 118, 119 and in a second pair of drive rollers 120, 121. The pairs of drive rollers 118, 119 and 120, 121 themselves are firmly mounted in a mounting 36, it being possible for the mounting 36 itself to be moved to and fro in the conveying direction of the holding conveyors 5 and 6, so that correct alignment with the longitudinal course of the circulating auxiliary mandrels 24 is always ensured. In order to load the sleeve 27 of the auxiliary mandrel 24, the mounting 36 moves synchronously with the holding conveyors 5, 6, while the opened tubular film is pushed onto the sleeve 27 in accordance with a predefinition. After reaching a predefined cut-off length, the tubular film is cut up between the end of the opening mandrel 17 and the start of the auxiliary mandrel 24 with the aid of a circular knife 37. Then, the continuously following further auxiliary mandrel device is loaded with corresponding sections of tubular film. According to the invention, a plurality of opening mandrels can also be arranged one after another in the loading area and, by increasing the pushing-on speed, a greater number of auxiliary mandrels provided with sleeves can be loaded, which leads to a considerable increase in the output of sealed elongate objects 4.

FIG. 2*c* shows a system based on prior art. The system has not a further sleeve on which the film is located. To handle objects with different sizes and change forms is impossible with a system based on the prior art.

Figure 3:
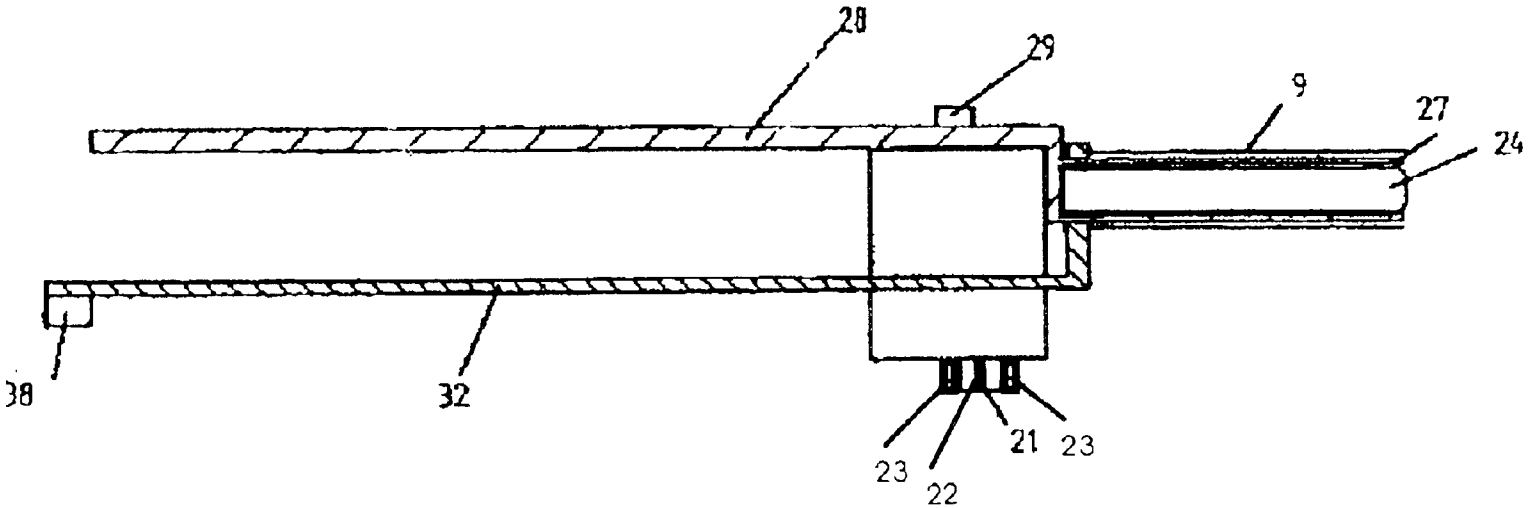
FIG. 3 shows a holding device with pushing arrangements arranged thereon on an enlarged scale.

FIG. 3 shows, on an enlarged scale, a movable holding device 7 having pins 21, an auxiliary mandrel 24 arranged on the movable holding device 7, a pushing device 28 guided in the movable holding device 7 and having a guide pin 29, the pushing device 28 being assigned to the sleeve 27, and a further pushing device 32 having a still further guide pin 38, which is likewise guided in the movable holding device 7 and on which the section 9 of tubular film is supported. The guide pin 38 lies in a guide groove in a slotted guide 33.

Figure 4:
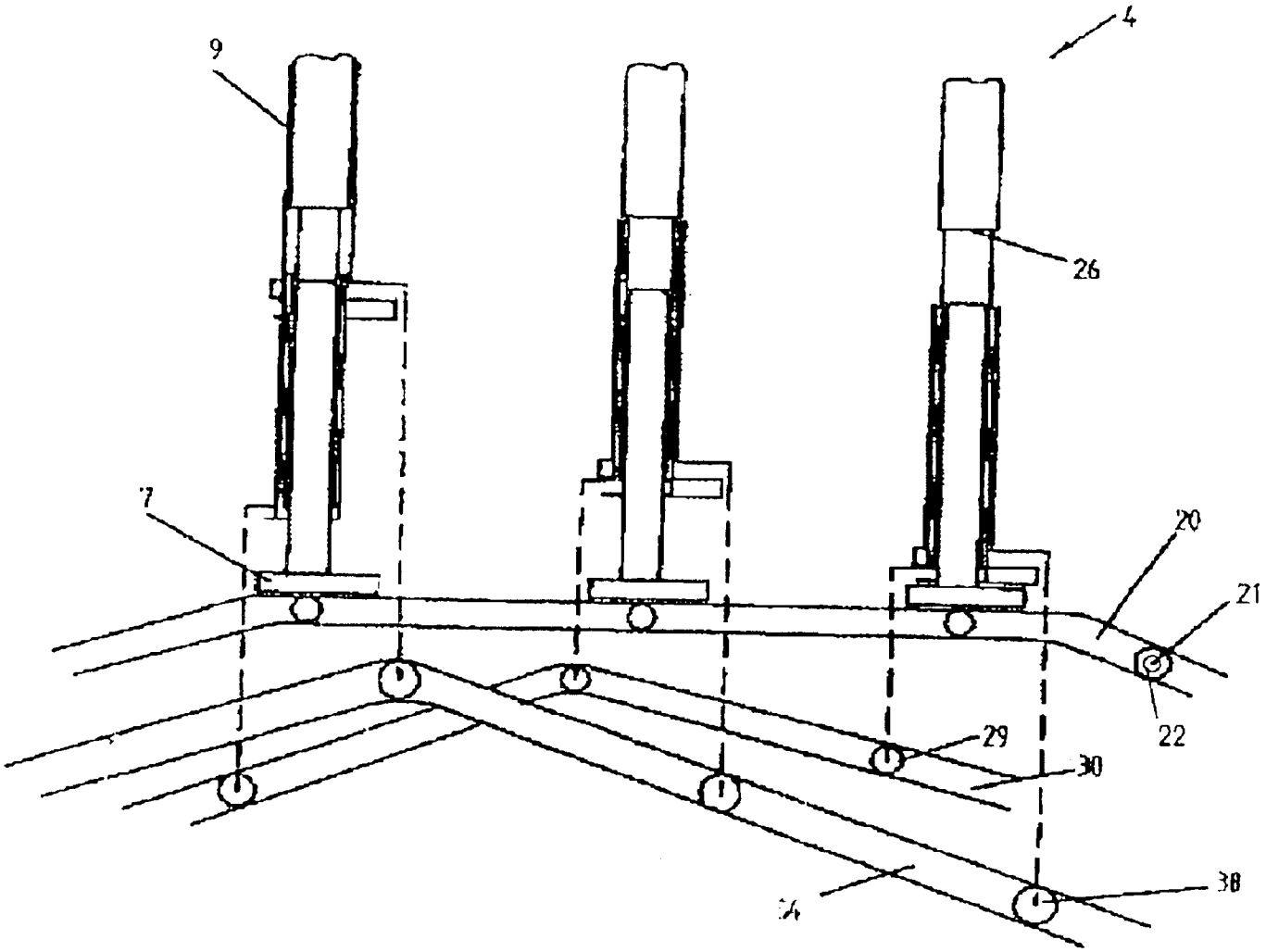
FIG. 4 shows the control of an operation of pushing onto an elongate body with a sudden cross-sectional change.

The control illustrated in FIG. 4 in the processing area explains the reliable transfer of the section 9 of tubular film onto the elongate object 4 having the shoulder 26 according to FIG. 2*a*. First of all, the pin 21 of the movable holding device 7 is pushed forward as far as the elongate object 4 as a result of the forward movement of the holding conveyor 5 corresponding to the course of the groove. After forming an operative connection between a surface of the elongate object 4 and the auxiliary pin, the groove no longer extends so as to rise in the forward direction, so that the operative connection is maintained without being strengthened.

The slotted guides 31 and 33 arranged separately from each other for the pushing device 28 and the further pushing device 32 have a further guide groove 30 and a further groove 34, whose slopes extending forward run parallel to each other. This ensures that, until the shoulder 26 is reached, without moving the section 9 of tubular film, the sleeve 27 is transported as far as the shoulder 26 by its pushing device 26, and the tubular film 9 is transported as far as the shoulder 26 without being moved by the further pushing device 32. The further guide groove 30 has a dome-like configuration at its front reversal point. This ensures that, after the shoulder has been reached by the leading edge of the sleeve, although the sleeve remains on the shoulder, no further increase in pressure takes place, while the guide groove arranged in the other slotted guide 33 pushes the section of the tubular film onto the thicker part of the elongate object via the further pushing device 32. The course of the further guide groove 30 is designed steeply in its falling part, so that the pushing device 28 rests on the front part of the moving holding device 7 as quickly as possible again, so that, after the predefined position of the section 9 of tubular film has been reached, with its leading edge on the thicker part of the elongate object, the object can be passed on continuously to the horizontal conveyor 10. Then, in the shrink tunnel 11, with continuous forward movement of the elongate objects transversely to the conveying direction of the horizontal conveyor 10, the respective section 9 of tubular film is shrunk onto the respective elongate body 4.

Figure 5:
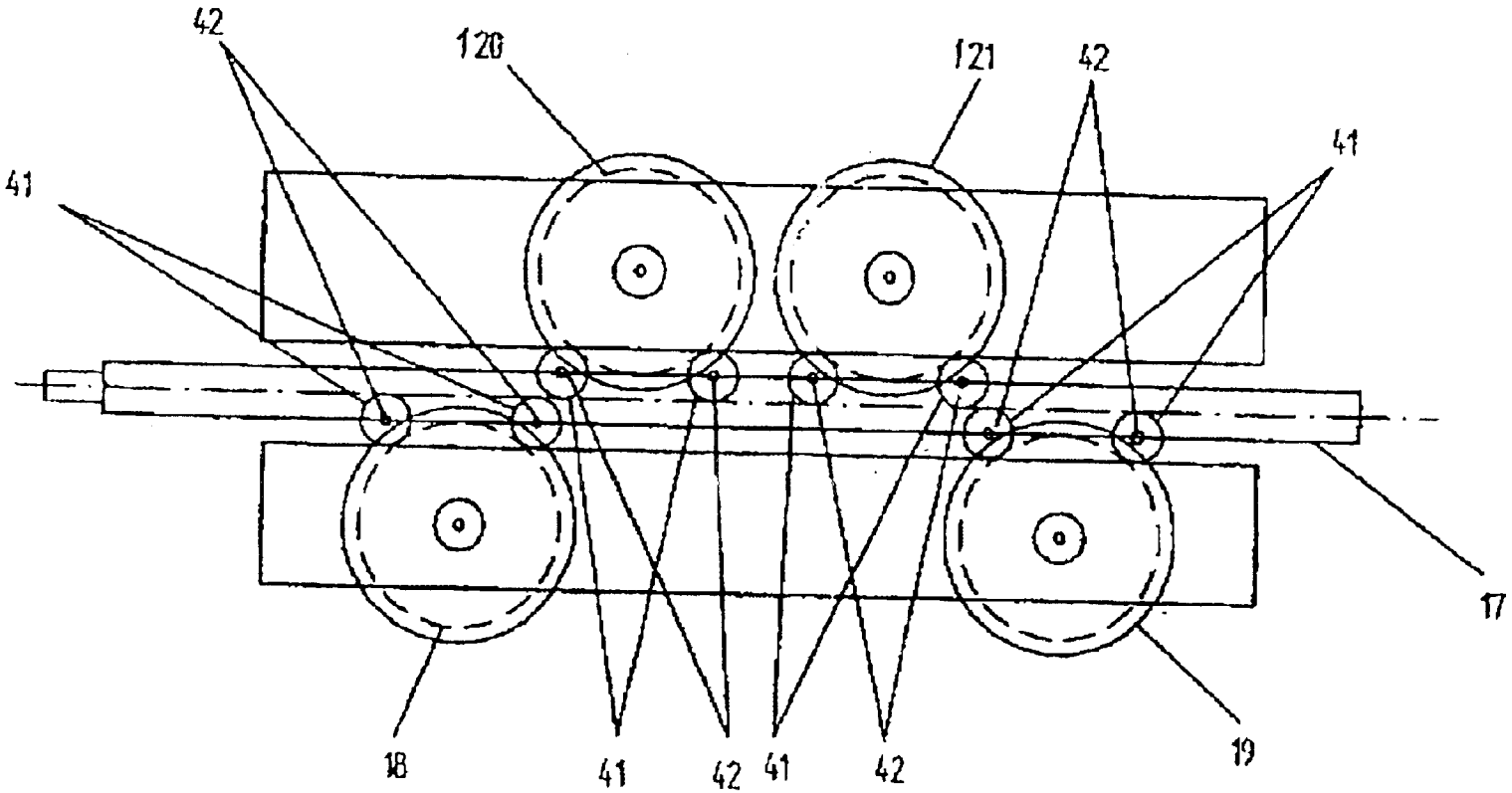
FIG. 5 shows an opening mandrel in elevation and plan view.

FIG. 5 illustrates the mounting of the opening mandrel 17 between a first pair of drive rollers 118, 119, which support the opening mandrel 17 horizontally, and a further pair of drive rollers 120, 121, which are arranged above the opening mandrel 17 and ensure horizontal guidance of the opening mandrel. Here, with simultaneous reliable opening of a flat tubular film, which is opened by a flat mandrel tip 40 (cf. FIG. 2), said film is subsequently guided in the opened state over the opening mandrel with the aid of the interaction in each case of a pair of opposing rollers 41 with a drive roller 118 and of a pair of opposing rollers 41 with a drive roller 120, without any expansion or compression of the tubular film taking place.

The drive rollers 118, 119, 120, 121 each have a V-shaped guide contour and therefore engage around the opening mandrel 17, so that reliable guidance of the opening mandrel 17 in the transverse direction is also ensured in this way.

FIG. 5 shows the opening mandrel 17 in elevation, in which the bores for the pairs of opposing rollers 41 with their roller axles 42 pass through the opening mandrel horizontally and transversely at the height of the longitudinal axis of the opening mandrel. Between each pair of opposing rollers 41, the opening mandrel 17 is milled out to accord with the V-shape, not illustrated, of the opening rollers 118 to 121, so that it is ensured that the pairs of opposing rollers 41 do not exceed the largest cross section of the opening mandrel at any point. This ensures that, in particular in the case of small tubular film diameters, damage resulting from the opening rollers or the respective pairs of opposing rollers is ruled out. When thin elongate objects are used, it is no longer the pairs of opposing rollers projecting beyond the mandrel which are decisive, but instead the opening mandrel diameter on its own.

| | |
|---|---|
| 1. | DE 197 37 689 |
| 2. | DE 34 24 081 A |
| 3. | DE 23 21 457 A |
| 4. | DE 199 08 395 C2 |
| 5. | DE 23 2 14 57 |

I claim:

1. An apparatus for pushing sections of tubular film over elongate objects, which preferably have varying cross sections, comprising one or two continuously movable endless holding conveyors which hold the objects with holding devices, preferably at one or both ends, to transport the objects lying down transversely with respect to their longitudinal extent, comprising a tubular film pushing device to push the section of tubular film, wherein said apparatus comprises a pushable sleeve with means to move the sleeve synchronously with the holding conveyors, the section of tubular film can be arranged on the sleeve, the outer diameter of the sleeve corresponds at least to the largest cross section of the object, wherein said apparatus comprises a sleeve pushing device, to guide the sleeve over the object before the tubular film pushing device pushes the film, while the pushable sleeve is pulled back by the sleeve pushing device, wherein the sleeve pushing device for guiding the sleeve has a guide pin which is guided in a guided groove, and wherein the film pushing device for pushing the section of tubular film onto the object is in connection to a third pin which is guided in a third guide groove.

2. The processing apparatus as claimed in claim 1, wherein a mandrel is in connection with a second pin being guided in a second groove, to bring the mandrel into an operative connection with the object as the holding conveyor moves forward.

3. The processing apparatus as claimed in claim 1, wherein drive rollers are in relation to an opening mandrel, to push the tubular film over a mandrel, and the opening mandrel is in axial elongation to the sleeve, to feed the sleeve with the tubular film.

4. The processing apparatus as claimed in claim 3, wherein a circular knife is arranged between the sleeve and the opening mandrel, to cut off sections of tubular film from the tubular film.

5. The processing apparatus as claimed in claim 3, wherein the opening mandrel is based on a bearing, to move the opening mandrel a least for a short time synchronously in the conveying direction of the holding conveyors.

6. The processing apparatus as claimed in claim 3, wherein the drive rollers each have a guide groove on the circumference and a pair of opposing rollers is assigned to them.

7. The processing apparatus as claimed in claim 6, wherein the opposing rollers are mounted in cutouts in the opening mandrel.

8. The processing apparatus as claimed in claim 6, wherein axes of the opposing rollers extend transversely to and through a central axis of the opening mandrel, and wherein the opening mandrel has notches in the area of the opposing rollers.

9. An apparatus for pushing sections of tubular film over elongate objects, which preferably have varying cross sections, comprising one or two continuously movable endless holding conveyors which hold the objects with holding devices, preferably at one or both ends, to transport the objects lying down transversely with respect to their longitudinal extent, comprising a tubular film pushing device to push the section of tubular film, wherein said apparatus comprises a pushable sleeve with means to move the sleeve synchronously with the holding conveyors, the section of tubular film can be arranged on the sleeve, the outer diameter of the sleeve corresponds at least to the largest cross section of the object, wherein said apparatus comprises a sleeve pushing device, to guide the sleeve over the object before the tubular film pushing device pushes the film, while the pushable sleeve is pulled back by the sleeve pushing device, wherein the sleeve pushing device for guiding the sleeve has a guide pin which is guided in a guided groove, and wherein a mandrel is in connection with a second pin being guided in a second groove, to bring the mandrel into an operative connection with the object as the holding conveyor moves forward.

10. An apparatus for pushing sections of tubular film over elongate objects, which preferably have varying cross sections, comprising one or two continuously movable endless holding conveyors which hold the objects with holding devices, preferably at one or both ends, to transport the objects lying down transversely with respect to their longitudinal extent, comprising a tubular film pushing device to push the section of tubular film, wherein said apparatus comprises a pushable sleeve with means to move the sleeve synchronously with the holding conveyors, the section of tubular film can be arranged on the sleeve, the outer diameter of the sleeve corresponds at least to the largest cross section of the object, wherein said apparatus comprises a sleeve pushing device, to guide the sleeve over the object before the tubular film pushing device pushes the film, while the pushable sleeve is pulled back by the sleeve pushing device, wherein the sleeve pushing device for guiding the sleeve has a guide pin which is guided in a guided groove, wherein drive rollers are in relation to an opening mandrel, to push the tubular film over a mandrel, and the opening mandrel is in axial elongation to the sleeve, to feed the sleeve with the tubular film, and wherein the opening mandrel is based on a bearing, to move the opening mandrel a least for a short time synchronously in the conveying direction of the holding conveyors.

11. The processing apparatus as claimed in claim 10, wherein the opposing rollers are mounted in cutouts in the opening mandrel.

12. The processing apparatus as claimed in claim 10, wherein axes of the opposing rollers extend transversely to and through a central axis of the opening mandrel, and wherein the opening mandrel has notches in the area of the opposing rollers.

13. An apparatus for pushing sections of tubular film over elongate objects, which preferably have varying cross sections, comprising one or two continuously movable endless holding conveyors which hold the objects with holding devices, preferably at one or both ends, to transport the objects lying down transversely with respect to their longitudinal extent, comprising a tubular film pushing device to push the section of tubular film, wherein said apparatus comprises a pushable sleeve with means to move the sleeve synchronously with the holding conveyors, the section of tubular film can be arranged on the sleeve, the outer diameter of the sleeve corresponds at least to the largest cross section of the object, wherein said apparatus comprises a sleeve pushing device, to guide the sleeve over the object before the tubular film pushing device pushes the film, while the pushable sleeve is pulled back by the sleeve pushing device, wherein the sleeve pushing device for guiding the sleeve has a guide pin which is guided in a guided groove, wherein drive rollers are in relation to an opening mandrel, to push the tubular film over a mandrel, and the opening mandrel is in axial elongation to the sleeve, to feed the sleeve with the tubular film, and wherein the drive rollers each have a guide groove on the circumference and a pair of opposing rollers is assigned to them.

14. The processing apparatus as claimed in claim 13, wherein the opposing rollers are mounted in cutouts in the opening mandrel.

15. The processing apparatus as claimed in claim 13, wherein axes of the opposing rollers extend transversely to and through a central axis of the opening mandrel, and wherein the opening mandrel has notches in the area of the opposing rollers.

* * * * *